US005301883A

United States Patent [19]

Lukaart

[11] Patent Number: 5,301,883

[45] Date of Patent: Apr. 12, 1994

[54] METHOD AND APPARATUS FOR CONSOLIDATING PARTIALLY USED TOILET TISSUE ROLLS

[76] Inventor: Dale J. Lukaart, 4733 N. Pine Hills Rd, #56, Orlando, Fla. 32808

[21] Appl. No.: 983,669

[22] Filed: Dec. 1, 1992

[51] Int. Cl.[5] ..... B65H 18/10

[52] U.S. Cl. ..... 242/67.3 R

[58] Field of Search ..... 242/67.3 R, 67.1 R, 242/67.2, 56 R, 71.8, 71.9, 75.4

[56] References Cited

U.S. PATENT DOCUMENTS

| | | | |
|---|---|---|---|
| 795,507 | 7/1905 | Hatfield et al. | 242/67.3 R |
| 2,794,606 | 6/1957 | Miller | 242/67.3 R |
| 3,175,780 | 3/1965 | Nettles | 242/67.3 R |
| 3,309,037 | 3/1967 | Amos | 242/67.3 R |
| 3,967,789 | 7/1976 | Deletzke | 242/56 R |
| 4,566,647 | 1/1986 | Iwamoto et al. | 242/67.1 R |

*Primary Examiner*—John M. Jillions
*Attorney, Agent, or Firm*—Warren L. Franz

[57] ABSTRACT

An apparatus and method for consolidating partially used rolls of conventional, private bathroom-sized rolls of toilet tissue as a cost saving measure for reuse in furnishing "new" rolls to overnight guests in the hotel/-motel industry is disclosed. The apparatus includes a housing, supply and take-up reels mounted on the housing and having vertically extending spindles which are bounded at the top by removable disk-shaped horizontally oriented cover plates and coaxially bounded at the bottom by disk-shaped horizontally oriented base plates. The cover plates are weighted to ensure positive gripping of the rolls. The take-up reel is motor driven and is automatically stopped when the roll has reached a predetermined full-sized roll diameter.

5 Claims, 2 Drawing Sheets

METHOD AND APPARATUS FOR CONSOLIDATING PARTIALLY USED TOILET TISSUE ROLLS

This invention relates to an apparatus and method for consolidating partially used rolls of conventional, private bathroom-sized rolls of toilet tissue; and, in particular, for consolidating the same as a cost saving measure for reuse in furnishing "new" rolls to overnight guests in the hotel/motel industry.

BACKGROUND OF THE INVENTION

Toilet tissue is customarily produced and sold in rolls comprising transversely perforated, elongated strips of paper wound on disposable, hollow, cylindrical cardboard tubes, adapted and sized for mounting in standard holders to enable convenient dispensing of one or more of the serially-related sheets by tearing at the perforations. Conventional toilet tissue rolls provided for private bathroom use in overnight guest accommodations in the hotel/motel industry, are of standard 4.5×4.4 inch roll size.

It is desirable when providing bathroom facilities associated with temporary lodgings to furnish guests with "new," i.e., full, rolls of toilet tissue, at least at the start of their stay. Partially used rolls, i.e., rolls partially depleted by prior guests, are discarded as trash. Such practice, however, results in considerable waste and needless expense. For example, a hotel having 600–700 rooms might well discard 16,000 to 20,000 partially used rolls per year, many of which may yet have 80% to 90% of the original tissue still left on the roll.

SUMMARY OF THE INVENTION

The present invention provides a simple and economical apparatus and method for reducing such waste and expense, by consolidating the remaining tissue of partially used rolls, into standard bathroom-sized full rolls.

BRIEF DESCRIPTION OF THE DRAWINGS

Embodiments of the apparatus and method of the invention have been chosen for purposes of illustration and description, and are shown with reference to the accompanying drawings, wherein.

Throughout the drawings, like elements are referred to by like numerals.

DETAILED DESCRIPTION OF PREFERRED EMBODIMENTS

Figure 1:
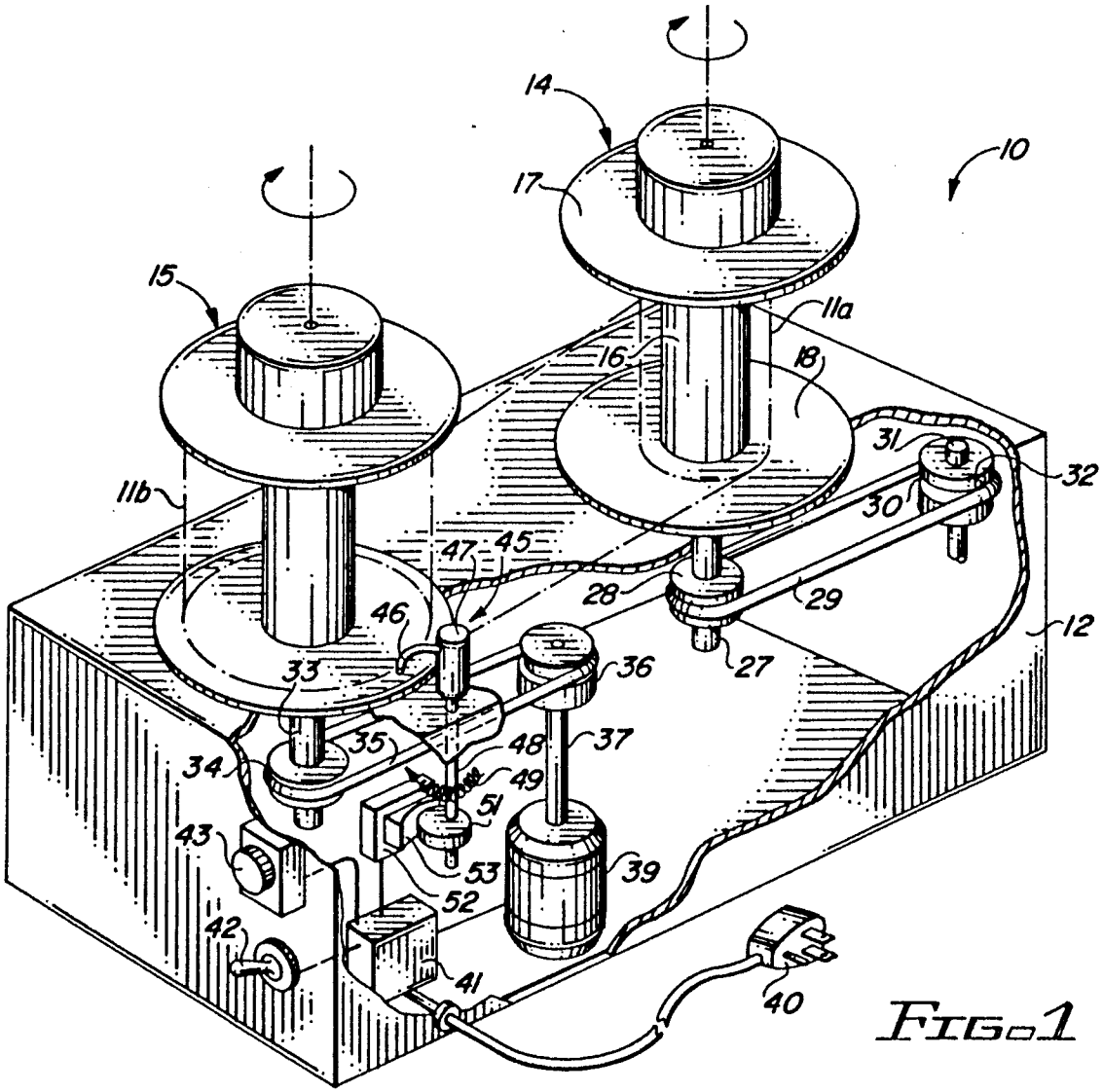
FIG. 1 is a block diagram view of an apparatus in accordance with the invention, usable in practicing the method of the invention.

FIG. 1 shows an apparatus 10 for consolidating partially used, standard bathroom-sized rolls of toilet tissue 11*a*, 11*b* into single, full rolls which have a 4.4 inch nominal outside diameter to fit into standard, conventional toilet tissue dispensers.

The apparatus 10 has a housing 12 on which are rotatably mounted supply and take-up reels 14, 15. Each reel 14, 15 has a spool-like shape comprising a vertically extending, elongated spindle 16, coaxially bounded at its top by a removable disk-shaped horizontally oriented cover plate 17, and coaxially bounded at its bottom by a like disk-shaped horizontally oriented base plate 18. The reels 14, 15 may be identical, and are sized to accommodate the dimensions of a full standard 4.4×4.5 inch sized roll 11, and to ensure that rotation of the reel 14, 15 will cause rotation of the roll, and vice versa.

Figure 2:
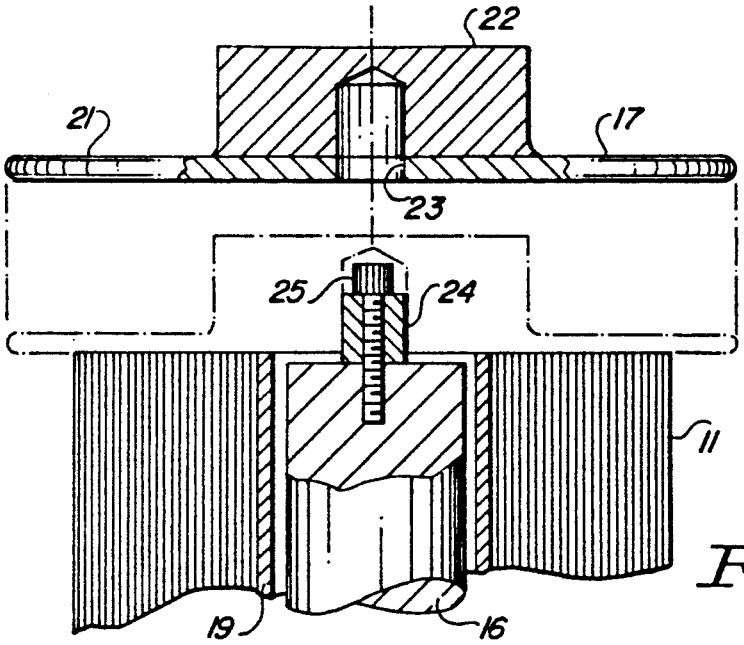
FIG. 2 is an exploded cross-sectional view of the top portion of a reel of FIG. 1.

As shown in FIG. 2, the spindle 16 has an outside diameter which is less than the inside diameter of the cylindrical cardboard core 19 of the standard roll 11. The plates 17, 18 have opposing, flat tissue contacting circular surfaces with diameters larger than the nominal 4.4 inch outside diameter of the full, new standard roll 11. The height (viz. vertical dimension) of spindle 16 above the tissue contacting, flat top surface of the base plate 18 is made slightly less than the 4.5 inch dimension of roll 11 in the core axial direction. This ensures positive gripping of roll 11 so that it rotates with the reel 14 or 15 when cover plate 17 is placed onto the spindle 16 from the solid to the dot-dashed line position shown in FIG. 2. Cover plate 17 comprises a horizontal, flat circular disk portion 21 and a smaller diameter, weighted cylindrical tubular portion 22 secured coaxially above the portion 21. Cover 17 has a downwardly open, blind central bore 23 that fits over a post 24 which rises centrally, axially up from the top of spindle 16. A fastener, such as an allenhead screw 25, passes axially through a central bore in post 24 and is threaded into the spindle 16. The fastener 25 acts to hold post 24 in place, and also serves as an adjustable stop to limit the extent of downward movement under gravity of the cover 17 onto the post 24, and thus as a limiting means for adjusting the amount of compression imparted to the roll 11. A spindle height of 4.4 inches and diameter of 1.45 inches is suitable. A cover and base plate platform diameter of 5.5 inches, or thereabouts, is also satisfactory.

The supply reel 14 is mounted for rotation on a depending shaft 27 which is journalled by conventional bearing means onto housing 12. A cylindrical pulley 28, keyed or otherwise held for rotation with the reel 14 and shaft 33, includes a circular groove about which a belt 29 extends. Belt 29 also extends about a groove in another pulley 30, spaced from pulley 28 and mounted on a second shaft 31 journalled within housing 12. Securement of pulley 30 onto shaft 31 is made adjustable by means of a threaded set screw 32, which may be set to control the amount of drag applied by belt 29 to resist excessive free rotation of the supply reel 14.

The take-up reel 15 is similarly mounted on a depending shaft 33 which is likewise journalled to the housing and which includes a pulley 34 keyed or otherwise held for rotation with the shaft 33. A belt 35 rotatably connects the pulley 34 with another pulley 36 coaxially mounted atop a drive shaft 37 of an electric drive motor 39. Motor 39 functions to drive the pulley 36 and, thus, the reel 15 in the indicated rotational direction.

Power for motor 39 is supplied by plug means 40 which connects to motor 39 through a switch circuit 41. An on-off toggle switch 42 acts to make or break the power connection, and a pushbutton switch 43 serves to energize a coil in circuit 41, for purpose of making contact to start the motor 39. Automatic shut-off of motor 39 in response to generation of a full roll 11*b* at the take-up reel 15 is accomplished by means of a feeler switch, indicated generally at 45. Feeler switch 45 includes a curved finger 46 extending in the direction of wind-up of roll 11*b*, outwardly from a post 47 mounted atop a rotatable vertical rod 48. Biasing means in the form of a spring, indicated schematically at 49, urges the finger 46 in the clockwise direction, into contact with the expanding outer surface of the roll 11*b*. An eccentric, in the form of a cylindrical element 51 mounted eccentrically adjacent a lower end of rod 48, is contacted by a roller of a switch member 52, so that an arm 53 carrying the roller is moved to the switch 52 "off" position, when the eccentric 51 is shifted to a position corresponding to movement of finger 46 outwardly for a diameter of a full roll 11*b*.

Figure 3A:
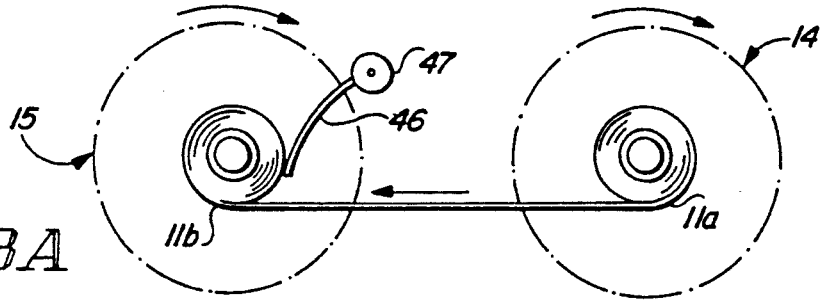
FIGS. 3A–3C are schematic views helpful in understanding the method employing the apparatus of FIGS. 1 and 2.
Figure 3B:
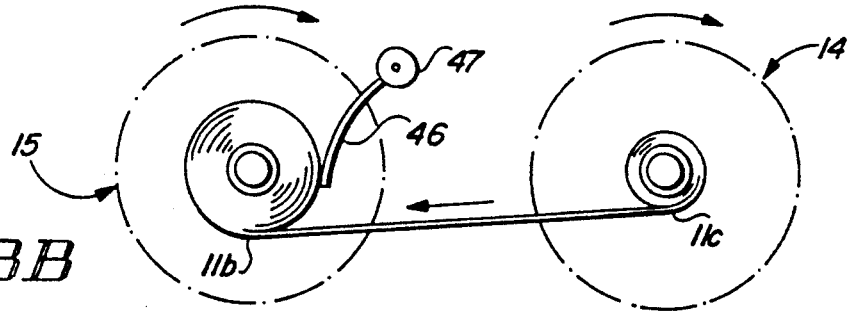
Figure 3C:
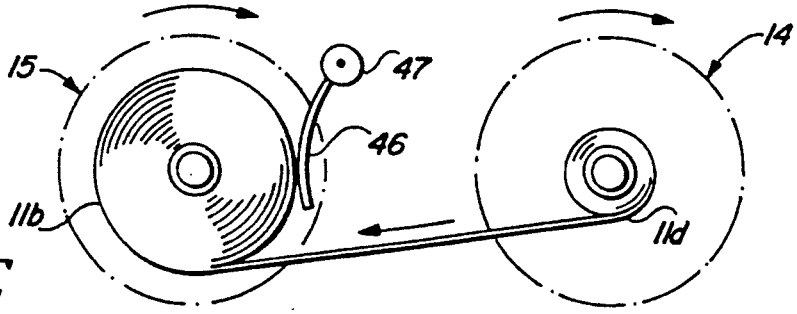

The method of the invention is described with reference to FIGS. 3A-3C, which show successive steps in the employment of apparatus 10 for consolidating into a full diameter roll the remaining sheets of tissue from a plurality of partially used rolls 11*a*–11*d*. The rolls 11*a*–11*d* are removed, for example, from the bathroom toilet tissue dispensers of overnight guest quarters of a hotel or motel. Each roll is of standard private bathroom roll size, having a sheet width in the core axial direction of 4.5 inches, and an original, before use, nominal outside diameter of 4.4 inches. New rolls are placed in the guest quarter bathrooms, and rolls 11*a*–11*d* represent the remnants thereof which are the connected unused sheets of tissue still wrapped around the original cardboard core.

The top cover 17 is lifted off the spindle 16 (see FIG. 2) of the supply reel 14 (FIG. 1), and the core 19 of roll 11*a* is brought vertically coaxially over the spindle 16. Roll 11*a* is loaded so that tissue will be unwound in the clockwise direction, as indicated. As described with reference to FIG. 2, the core and remaining tissue of roll 11*a* will be slightly above the top surface of the spindle 16. Cover 17 is then replaced over the spindle, with projection 24 and fastener 25 being received into the opening formed by bore 23. The weight of cover 17 causes the flat undersurface of cover portion 21 to compress roll 11*a*, as cover 17 is brought from the solid to dot-dashed line position of FIG. 2. Such compression holds the roll 11*a* for rotation with the spool 14, and enables roll 11*a* to be moved when cover 17 is manually rotated by gripping the weighted portion 22.

The second partially used roll 11*b* is loaded vertically onto the spindle 16 of take-up reel 15 in the same manner. To provide clearance during loading of the second roll 11*b*, finger 46 is first rotated counterclockwise against the bias of spring 49 (FIG. 1), then released to rest against the cylindrical outer surface presented by the remaining tissue on roll 11*b*. Roll 11*b* is loaded so that added tissue will be wound in the same direction as remaining tissue, when reel 15 is rotated in the clockwise direction, as indicated. As shown, finger 46 is pointed in the same direction and arced to ride smoothly on the surface of the expanding roll 11*b*, without tearing the added tissue.

After the two partially used rolls 11*a* and 11*b* have been loaded, the free end of the remaining tissue is drawn out from roll 11*a* and wrapped once or twice around the outside of roll 11*b*, by turning the cover 17 of reel 15 by hand in the clockwise direction. The compression of roll 16 under the weight of the cover ensures that roll 11*b* will be rotated with the cover 17. This secures the free end of roll 11*a* tissue about the outside of tissue remaining on roll 11*b*. The on-off switch 42 is now to the "on" position, and the pushbutton switch 43 is depressed, energizing the coil within circuit 41 to deliver current to the motor 39. Motor 39 now acts through the coupled shafts 33, 37, to drive the take-up reel 15 in the clockwise direction. In this manner, the remaining tissue, whose leading end was previously secured to the outside of roll 11*b*, will be unwound from the roll 11*a* (see FIG. 3A), until just the roll 11*a* core 19 is left.

Supply reel 14, as described above, is journalled for free rotation, so will be rotated as the roll 11*a* tissue is drawn off. The amount of drag supplied by the band 29 on the pulley 27 is determined by the setting of screw 30. The drag is set so that momentary overrotation of reel 14 or hesitation of reel 15 will not cause an excessive amount of free tissue to be dispensed into the gap between reels 14, 15, but that the unwinding tissue is not held so taut that it tears.

When roll 11*a* is completely unwound, rotation of reel 15 is stopped and another partly used roll 11*c* (see FIG. 3B) is loaded onto reel 14, in place of the remaining core 19 of roll 11*a*. The user may stop rotation either by manually moving the finger 46 counterclockwise until the diameter limit switch 52 acts, or by momentarily setting the switch 42 into the "off" position. When the third roll 11*c* is in place, the process is resumed in the same manner as before. The leading edge of roll 11*c* is affixed by hand rotation of cover 17, about the expanding roll 11*b* which now contains the remaining tissue from both rolls 11*a* and 11*b*. The rotation of take-up reel 15 by motor 39 is then restarted until the remaining tissue has been unwound also from roll 11*c*. This procedure continues, adding the remaining tissue from further rolls 11*d* (see FIG. 3C), and so on, until tissue has been added onto roll 11*b* in sufficient quantity to expand roll 11*b* to the desired end diameter, viz. the nominal 4.4 inches of new standard-sized rolls. The finger 46 rides the outer surface of roll 11*b* to automatically track the expanding diameter of roll 11*b*. When the predesignated diameter is reached, eccentric 51 which rotates on rod 48 together with post 47, will move to a position to activate the limit switch 52 and disconnect power from the motor 39, thereby stopping the process. At this point, unless roll 11*d* is fully unwound, the tissue extending between the reels 14, 15 is severed. The cover 17 of reel 15 is lifted, and the now full roll 11*b* is removed from the apparatus 10, and replaced with another partly used roll, to repeat the process. The roll 11*a*, now expanded to its original unused roll size, can then be returned to the bathroom dispenser of one of the hotel or motel rooms from which the partially used rolls 11*a*–11*d* were taken, for the use and convenience of a new guest occupant.

Those skilled in the art to which the invention relates will appreciate that various substitutions and modifications can be made to the described embodiment, without departing from the spirit and scope of the invention as described by the claims set forth below.

What is claimed is:

1. A method for consolidating partially used standard private bathroom-sized rolls of toilet tissue into single, full-sized diameter ones of said rolls, the method comprising the steps of:

removing a plurality of partially used ones of said rolls from the bathroom toilet tissue dispensers of overnight guest quarters of a hotel or motel;

placing a first one of said rolls onto a first vertically extending spindle and compressing it against a first base plate rotationally mounted on a housing;

placing a second one of said rolls onto a second vertically extending spindle and compressing it against a second base plate rotationally mounted on said housing;

drawing a free end of the remaining tissue out from said first roll and securing said free end to said second roll by wrapping said free end about said second roll;

rotating said second base plate by motor about an axis coaxial with said spindle, to further draw more of the remaining tissue from said first roll and wrap it about said second roll;

automatically disengaging said motor when said second roll has reached said full-sized roll diameter; and returning said second roll with said full-sized roll diameter back to one of said hotel or motel guest quarter dispensers.

2. Apparatus for consolidating partially used, standard private bathroom-sized rolls of toilet tissue into single, full-sized diameter ones of said rolls; each roll having a hollow cylindrical core of given height and inside diameter and having a length of toilet tissue of given width equal to said core height wrapped about said core; the apparatus comprising:

a housing;

supply and take-up reels rotatably mounted on the housing;

each reel having a spool-like shape and including a vertically extending, elongated spindle; a disk-shaped horizontally oriented, weighted cover plate removably gravitationally received coaxially at the top of the spindle; and a disk-shaped horizontally oriented base plate attached coaxially to the bottom of the spindle; the spindle having an outside diameter less than said inside diameter of the cores; the plates having opposing, tissue contacting flat circular surfaces with diameters larger than said full-sized roll diameter; and the spindle having a height above the tissue contacting surface of the base plate which is slightly less than said core height;

stop means for guiding the cover plate onto the spindle for controllably compressing a roll received about the spindle under weight of the cover plate, so that rotation of the reel will cause rotation of the roll; and motive means for rotating the take-up reel.

3. Apparatus as in claim 2, wherein the stop means comprises a post rising centrally axially up from the top of the spindle; and the cover plate being formed with a downwardly opening blind central bore into which the post is received.

4. Apparatus as in claim 3, wherein each reel has a threaded fastener passing through the post into the spindle, the fastener being configured to act as an adjustable stop to limit the downward movement under gravity of the top cover onto the post.

5. Apparatus as in claim 2, wherein the apparatus further comprises drag means for controllably resisting free rotation of the supply reel.

* * * * *